US008136491B2

(12) United States Patent
Rudert et al.

(10) Patent No.: US 8,136,491 B2
(45) Date of Patent: Mar. 20, 2012

(54) STROKE-TRANSMITTING DEVICE

(75) Inventors: Stefan Rudert, Stuttgart (DE); Thomas Stolk, Kirchheim (DE); Alexander von Gaisberg-Helfenberg, Beilstein (DE)

(73) Assignee: Daimler AG, Stuttgart (DE)

( * ) Notice: Subject to any disclaimer, the term of this patent is extended or adjusted under 35 U.S.C. 154(b) by 847 days.

(21) Appl. No.: 12/284,626

(22) Filed: Sep. 24, 2008

(65) Prior Publication Data

US 2009/0095242 A1 Apr. 16, 2009

Related U.S. Application Data

(63) Continuation-in-part of application No. PCT/EP2007/002456, filed on Mar. 20, 2007.

(30) Foreign Application Priority Data

Mar. 25, 2006 (DE) ..... 10 2006 013 915

(51) Int. Cl.
*F01L 1/34* (2006.01)

(52) U.S. Cl. ..... 123/90.16

(58) Field of Classification Search ..... 123/90.15, 123/90.16
See application file for complete search history.

(56) References Cited

U.S. PATENT DOCUMENTS

| | | | | |
|---|---|---|---|---|
| 5,056,476 | A | 10/1991 | King | |
| 6,481,399 | B1 | 11/2002 | Morrn | |
| 7,261,074 | B2 * | 8/2007 | Kim et al. | 123/90.16 |
| 7,363,895 | B2 * | 4/2008 | Tashiro et al. | 123/90.16 |
| 7,451,729 | B2 * | 11/2008 | Sugiura et al. | 123/90.16 |
| 7,823,552 | B2 * | 11/2010 | Kwon et al. | 123/90.16 |

FOREIGN PATENT DOCUMENTS

| | | | |
|---|---|---|---|
| DE | 10061618 | A1 | 6/2002 |
| DE | 10061618 | B4 | 6/2002 |
| DE | 10119686 | A1 | 11/2002 |
| DE | 10123186 | A1 | 11/2002 |
| DE | 10140635 | A1 | 4/2003 |
| DE | 10306907 | B4 | 9/2004 |
| DE | 10341702 | A1 | 4/2005 |
| DE | 102004035005 | A1 | 2/2006 |
| EP | 1039103 | A2 | 9/2000 |
| JP | 58-87904 | | 6/1983 |
| WO | 2004/088099 | A1 | 10/2004 |

* cited by examiner

*Primary Examiner* — Thomas Denion
*Assistant Examiner* — Daniel Bernstein
(74) *Attorney, Agent, or Firm* — Klaus J. Bach

(57) ABSTRACT

In a stroke-transmitting device for a variable transmission of an operating stroke to a member to be actuated, specifically a gas exchange valve for an internal combustion engine, including a control unit with first and second control structures, a control cam is provided for coupling the first and second control structures and having different control regions which are displaceable for an adjustment of the stroke of the member to be actuated with at least first and second degrees of freedom for controlling the stroke transmitted to the member to be actuated.

10 Claims, 2 Drawing Sheets

STROKE-TRANSMITTING DEVICE

This is a Continuation-In-Part Application of pending international patent application PCT/EP2007/002456 filed Mar. 20, 2007 and claiming the priority of German patent application 10 2006 013915 filed Mar. 25, 2006.

BACKGROUND OF THE INVENTION

The invention relates to a stroke-transmitting device in particular for operating gas exchange valves of an internal combustion engine.

A stroke-transmitting device for the variable transmission of a camshaft stroke to a gas-exchange valve of an internal combustion engine is known from DE 100 61 618 B4. The stroke-transmitting device comprises a control unit having a first control means and a second control means which are coupled via a control cam and a support cam and are movable relative to one another in contact regions of the control cam and of the support cam in one degree of freedom during a constant adjustment of the stroke, the second control means being movable on the first control means in the circumferential direction thereof, which first control means comprises the control cam and the support cam. For adjusting the stroke, the first and second control means are movable relative to one another in the contact region of the control cam in the same degree of freedom in which the control means also move relative to one another during a constant adjustment of the stroke and, in order to adjust the stroke, the first control means can be pivoted about an axis, so that a relative movement between the first and second control means is produced in the circumferential direction of the first control means.

It is the principal object of the present invention to provide a stroke-transmitting device in which a stroke adjustment which is at least largely reaction-free is possible.

SUMMARY OF THE PRESENT INVENTION

In a stroke-transmitting device for a variable transmission of an operating stroke to a member to be actuated, specifically a gas exchange valve for an internal combustion engine, including a control unit with first and second control structures, a control cam coupling the first and second control structures and having different control regions which are displaceable for an adjustment of the stroke of the member to be actuated with at least first and second degrees of freedom (axially and rotationally) for controlling the stroke transmitted to the member to be actuated.

It is proposed that, in order to adjust the stroke, the first and second control structures are movable relative to one another in a contact region of a control cam in at least one second degree of freedom differing from the first degree of freedom. In this context a "control means or structure" should be understood to mean, in particular, a means which is positionally adjustable for variable transmission of a stroke. Differing "degrees of freedom" in a contact region of a control cam should be understood to mean, in particular, relative movement possibilities along lines of movement on the control cam which differ and, in particular, include an angle.

With the deviating degrees of freedom, reciprocal reactions can be at least reduced and preferably largely prevented, if the movements associated with the degrees of freedom are disposed at least substantially perpendicularly to one another, or the movements include an angle from 80° to 100° and preferably from 85° to 95°. Undesired errors can be avoided and high accuracy of adjustment can be achieved. In addition, a high flexibility of adjustment can be achieved.

Differing degrees of freedom can be achieved in a constructionally simple manner if at least one control means is displaceable translationally and, especially advantageously, is additionally rotatable about at least one axis. At least one of the control means is preferably configured as a thrust rod which is rotatable about its axis and is translationally displaceable along an axis, which thrust rod can be simply made especially stiff in the thrust direction, whereby high adjustment accuracy is attainable in a simple manner. In addition, an actuator for actuating the control means in the form of a thrust rod can be integrated in a space-saving manner, in particular on an end face of one of the control means, preferably of the translationally displaceable control means.

In a further embodiment of the invention it is proposed that the control cam has a constant radius in at least one direction in at least one cam area, whereby, during a constant adjustment of the stroke, undesired micro-movements caused by an eccentricity and the resulting wear can be avoided.

It is further proposed that at least one of the control means of the control unit has at least two control cams for at least two means to be actuated, whereby additional components, installation space, weight, assembly complexity and cost can be saved.

If the first and second control means for adjusting a difference between modes of the means to be actuated are movable relative to one another in at least one degree of freedom, especially flexible adjustability can be achieved. In particular, an operating mode of a means to be actuated can be adjusted without undesired effects occurring in the operating mode of a further means to be actuated. In this case, a "difference" should be understood to mean, in particular, a difference of stroke, such that, for example, the stroke of one means to be actuated can be increased or decreased relative to the stroke of the other means to be actuated.

This can be achieved in a space-saving manner, in particular, if the degree of freedom for adjusting the difference deviates from the degree of freedom with which a stroke-adjusting movement is associated and, in particular, if the degree of freedom for adjusting the difference coincides at least substantially with the degree of freedom with which a movement during a constant stroke-adjustment is associated, or if a movement for adjusting the difference deviates at least partially by less than 20° and preferably less than 10° from a movement during a constant stroke-adjustment.

In a further embodiment of the invention, the stroke-transmitting unit has an intermediate lever mounted in a spatially fixed manner. In this case a "spatially fixed mounting" should be understood to mean, in particular, a mounting which is swivelable about a spatially fixed axis, in particular about a material axis. An "intermediate lever" should be understood to mean, in particular, a one-part or multi-part lever which is mounted to be pivotable as a unit for transmitting a stroke movement. By means of appropriate configuration, an advantageously constructionally simple and cost-effective design with especially small tolerances can be achieved, in particular if the intermediate lever has a bearing zone for at least one control means. A control means of the control unit may advantageously be mounted via the bearing zone, and/or the intermediate lever may advantageously be mounted via the bearing zone. In this case, "via" should be understood to mean, in particular, that a control means may be mounted on and/or in the intermediate lever and/or the intermediate lever may be mounted on and/or in a control means. Through appropriate configuration, a plurality of relevant geometries can be associated with a component, specifically with the intermediate lever, whereby said geometries can be produced especially accurately, so that undesired tolerances can be minimized, in particular if, during manufacture, one bearing zone for mounting the intermediate lever is at least machined in one process step and a further bearing zone on the intermediate lever is at least machined in a following process step. In this case "at least machined" should be understood to mean, in particular, that the bearing zone can be both produced and, in particular, finished. Furthermore, a "following process step" should be understood to mean both a directly following process step and a process step which follows subsequent process steps. Furthermore, with the inventive solution an especially compact construction can be achieved with few components.

The invention and advantages thereof will become more readily apparent from the following description an exemplary embodiment thereof with reference to the accompanying drawings.

DESCRIPTION OF AN EXEMPLARY EMBODIMENT

Figure 1:
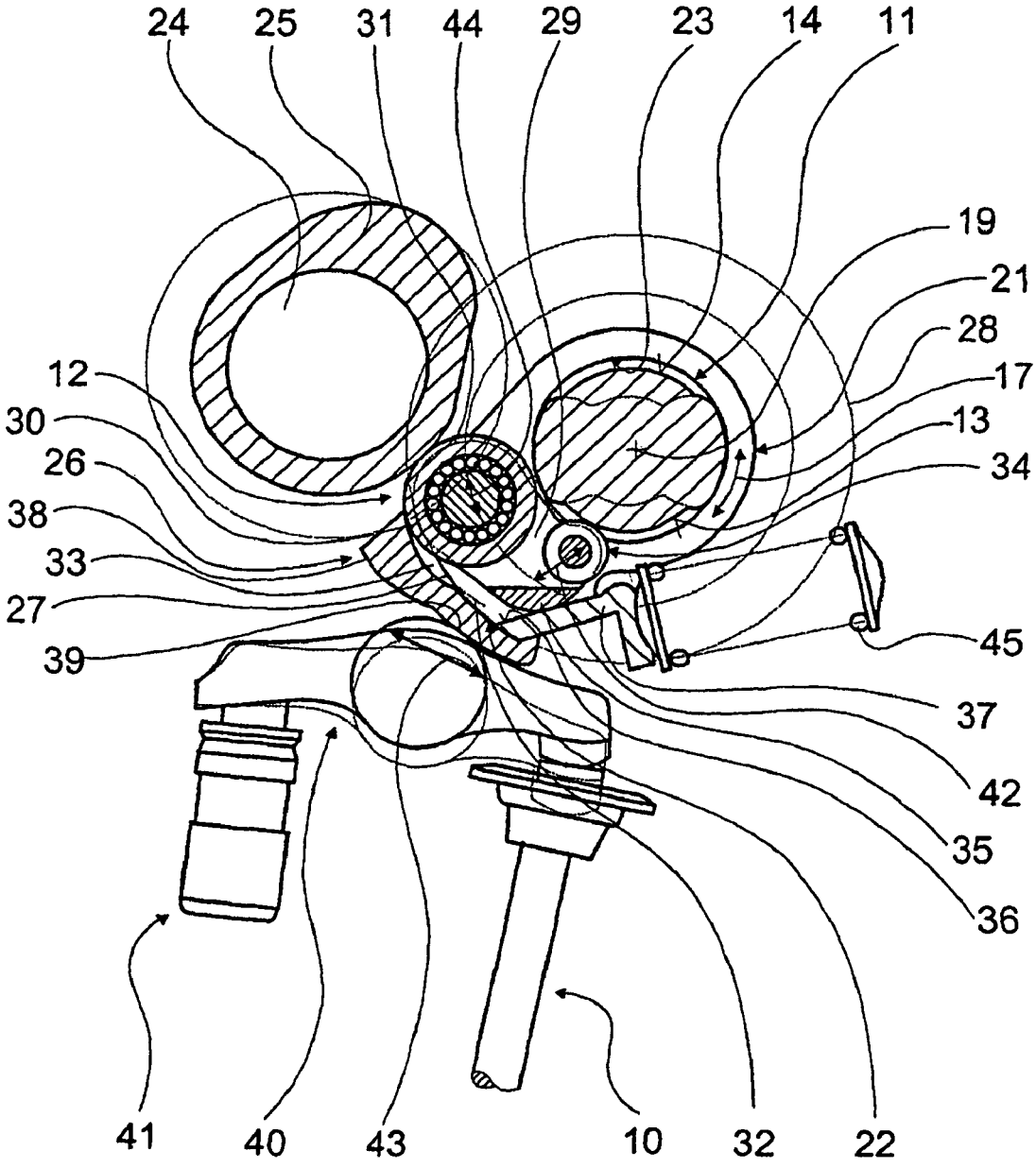
FIG. 1 shows schematically a portion of an internal combustion engine with a stroke-transmitting device according to the invention.

FIG. 1 shows a schematically represented portion of an internal combustion engine with an inventive stroke-transmitting device for variable transmission of a camshaft stroke of a cam 25 arranged on a camshaft 24 to a gas-exchange valve 10 of the internal combustion engine. The stroke-transmitting device includes an intermediate lever 21 mounted pivotally about a spatially fixed axis 19. The stroke-transmitting device further includes a control unit.

The intermediate lever 21 has a first bearing zone 23 formed by an edge delimiting a circular opening, via which said intermediate lever 21 is mounted pivotally on a control means 11 formed by a thrust rod which is rotatable about the axis 19 and is axially displaceable. The control means 11 serves as the material bearing axis of the intermediate lever 21. In addition, the intermediate lever 21 has between its free end 26 and the first bearing zone 23 a second bearing zone 22, via which a control means 12 formed by an elbow lever or expanding link is guided along a guide cam 27, in the form of a circular segment and formed integrally on the intermediate lever 21, on a circular path 28 concentric with the axis 19 of the intermediate lever 21.

The control means 12, or expanding link, which is integrated in the intermediate lever 21 comprises a main body 29 and a rotatably mounted input follower member 30 formed by a cam follower on an end of the main body 29. The input follower member 30 has the form of a roller. The main body 29 has configured thereon in the region of the input follower member 30 a curvature 31 in the form of a circular segment concentric with the input follower member 30, with which the main body 29, and therefore the input follower member 30, is guided in operation on the guide cam 27 of the intermediate lever 21, which guide cam 27 is configured concentrically with the axis 19, on the circular path 28. Alternatively and/or additionally, however, the main body 29, and therefore the input follower member 30, might be guided movably on a path 32 deviating from the circular path 28 concentric with the axis 19 of the intermediate lever 21, as is indicated in FIG. 1. To enable the input follower member 30 to rotate within its range of movement, a recess 33 is formed in the intermediate lever 21 in the range of movement of the input follower member 30.

Figure 2:
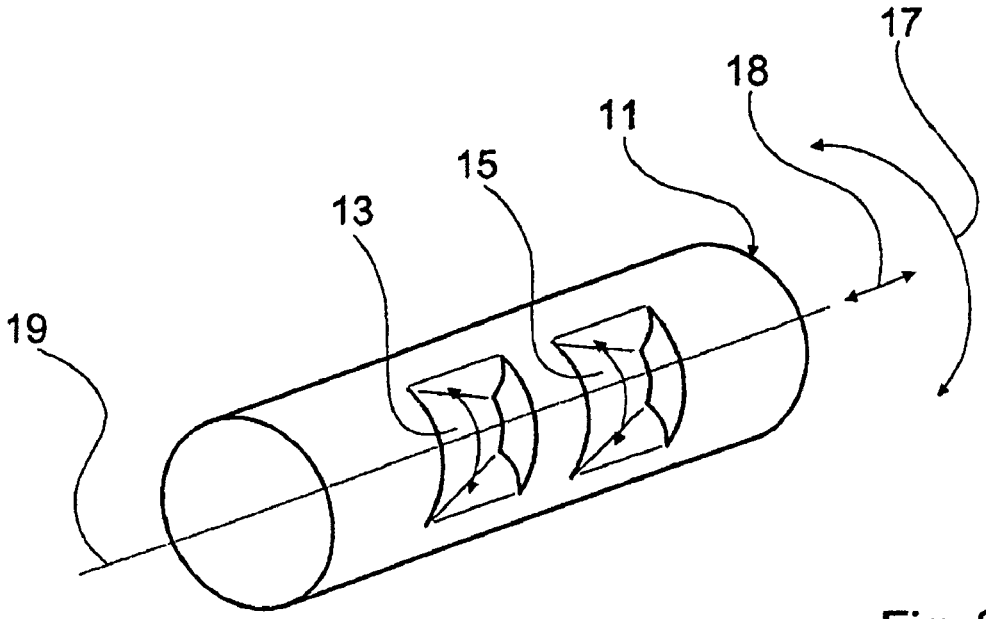
FIG. 2 shows a control means of the stroke-transmitting device separately in a perspective view.
Figure 3:
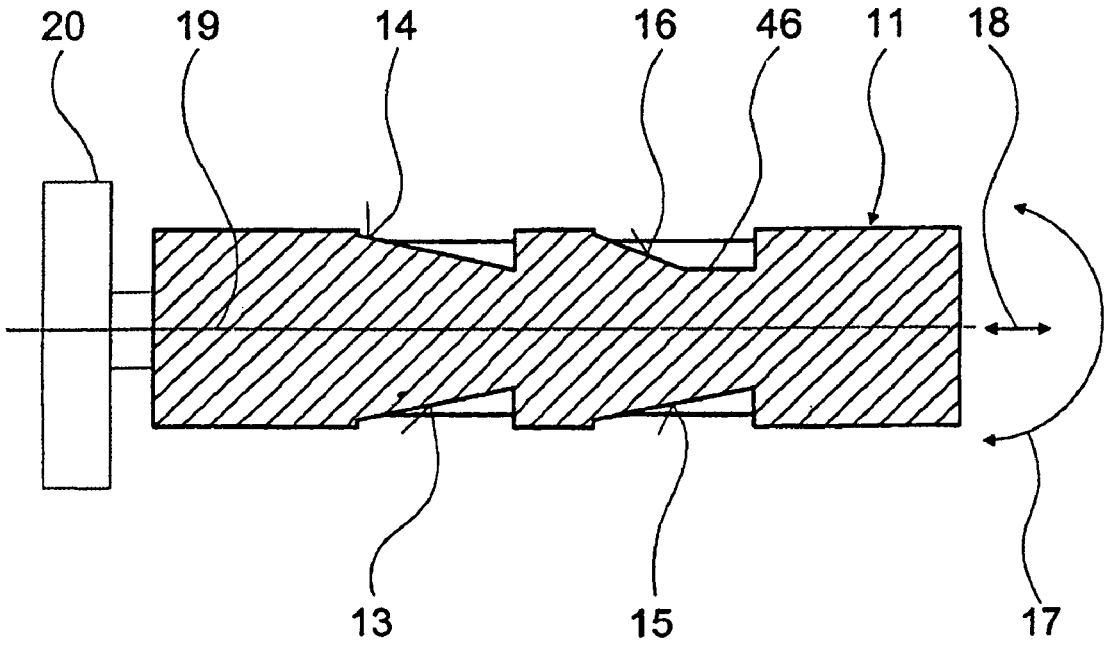
FIG. 3 shows, in a longitudinal sectional view, the control means of FIG. 2.

In addition, the control means 12, or the expanding link, has a follower member 34 mounted rotatably on a second end of the main body 29, which follower member 34 is provided for following the control cams 13, 14 (FIGS. 1, 2 and 3) formed on the control means 11.

Also arranged on the main body 29 is a guide shoe 35 which is coupled to a support contour 36 of a support means 37 rigidly connected to the intermediate lever 21. The intermediate lever 21 has a multi-part configuration, the bearing zone 23 being formed by a first part and the guide cam 27 by a second part, which parts are connected rigidly to one another. Because the guide cam 27 is formed by a separate part, the guide cam 27 may advantageously simply describe a circular path which is, at least partially, at least substantially (i.e. in particular within the predefined tolerances) concentric with the bearing axis of the intermediate lever 21, and as such may be connected to the first part of the intermediate lever 21. However, the guide cam 27 might also be formed at least partially integrally with the first part of the intermediate lever 21. The control means 12, or the expanding link, therefore has three contact points which substantially form a triangle.

A stroke cam 38 and a so-called zero-stroke cam 39 are formed integrally on the free end 26 of the intermediate lever 21. The stroke cam 38 is provided in order to generate a stroke of the gas-exchange valve 10 during operation, while the zero-stroke cam 39 is provided in order to prevent a stroke of the gas-exchange valve 10 during operation. In principle, it would also be possible for further stroke cams for further adjustments to be formed integrally on the free end of the intermediate lever 21. The free end 26 of the intermediate lever 21 acts on a roller lever 40 mounted in a spatially free manner, the first end of which bears against a clearance-compensating element 41 and a second end of which bears against a valve stem of the gas-exchange valve 10.

During manufacture, the bearing zone 23 for supporting the intermediate lever 21 is produced in one process step and then, in a following process step, the bearing zone 22 or the guide cam 27 itself is produced on the intermediate lever 21, for example preferably by swiveling the intermediate lever 21 about its axis 19 during manufacture. Because of the concentricity of the bearing zone 23 and the bearing zone 22 or the guide cam 27, these elements can be produced especially accurately.

During operation the input follower member 30 runs on the rotating cam 25. The intermediate lever 21 is thereby driven with a pivot motion, being mounted on the control means 11 which is stationary outside an adjusting mode. As this happens, the follower member 34 runs on the control cam 13 in the circumferential direction thereof in a profile-following zone with a constant radius, so that the control means 11, 12 move relative to one another in the circumferential direction of the control cam 13 in a contact region of the control cam 13 in a first degree of freedom 17 during a constant adjustment of the stroke.

If a stroke adjustment is to be performed, the control means 11 formed by a thrust rod is displaced in translation by means of an actuator 20 arranged on an end face of the control means 11, so that the first and second control means 11, 12 are moved relative to one another in the axial direction of the adjusting means 11 in a second degree of freedom 18 differing from the first degree of freedom, in the contact region of the control cam 13. The movements associated with the degrees of freedom 17, 18 are disposed perpendicularly to one another. The control means 11 has a frustroconical configuration in the region of the control cam 13, so that through displacement of the control means 11 within the degree of freedom 18, depending on the direction, the follower member 34 of the control means 12 moves radially outwards or radially inwards in relation to the axis 19 of the intermediate lever 21, as is indicated by an arrow 42. As this happens the support contour 36 of the intermediate lever 21 follows the guide shoe 35 of the main body 29 of the control means 12, or the expanding link, and executes a pivoting movement about the axis 19 towards the camshaft 24 or away from it, depending on the translational thrust direction of the control means 11, as is indicated by an arrow 43. As this happens the input follower member 30 follows the guide cam 27, as is indicated by an arrow 44. Depending on the thrust direction of the control means 11, either the stroke cam 38 or the zero-stroke cam 39 can be brought into contact with the roller lever 40, and the stroke of the gas-exchange valve 10 can thereby be adjusted. If the intermediate lever 21 is adjusted such that the zero-stroke cam 39 comes into contact with the roller lever 40, it is ensured by means of a helical compression spring 45 acting on the intermediate lever 21, for example via the support means 37, that the input follower member 30 always remains in contact without play with the cam 25, and the support contour 36 follows the guide shoe 35 of the main body 29 of the control means 12.

Because, as this happens, the input follower member 30 is moved along the guide cam 27 and therefore along the circular path 28 concentric with the axis 19, the pivoting movement of the intermediate lever 21 does not lead to any change of position of the input follower member 30 relative to the camshaft 24, and a displacement of the input follower member 30 in the advance or retard direction, and a change of a transmission ratio of the intermediate lever 21, are avoided. Should a specified displacement of the input follower member 30 in conjunction with a variation of an opening duration of the gas-exchange valve 10 be desired, a guide cam with a defined different profile can be selected instead of the guide cam 27 configured in the shape of a circular segment and concentric with the axis 19.

In addition to the control cams 13, 14 for the gas-exchange valve 10, the control means 11 has two further control cams 15, 16 for a further gas-exchange valve, which is not shown. The control cams 13, 14 associated with the gas-exchange valve 10, and the control cams 15, 16 associated with the gas-exchange valve not shown, are arranged one behind the other respectively in the circumferential direction, while the control cams 13, 15 and the control cams 14, 16 are arranged one behind the other respectively in the axial direction of the control means 11.

An intermediate lever which corresponds to the intermediate lever 21, and in which a control means corresponding to the control means 12 is integrated, is mounted in the region of the control cams 15, 16. The control means 11 can be rotated about the axis 19 by means of the actuator 20, whereby the first and second control means 11, 12 for adjusting a difference between modes of the gas-exchange valves 10 to be actuated are movable relative to one another in a degree of freedom coinciding with the degree of freedom 17, in the circumferential direction of the control means 11.

If the control cams 13, 15 are in contact with the control means 12, the gas-exchange valves 10 have the same operating modes, that is, the gas-exchange valves 10 are each actuated with the same stroke. If the control cams 14, 16 are in contact with the control means 12, the gas-exchange valves 10 have different operating modes, since the control cams 13, 14 correspond to one another whereas the control cams 15 and 16 differ. Through a translational displacement of the control means 11 a stroke deviating from a zero stroke can be set for the gas-exchange valve 10, and a zero stroke for the gas-exchange valve associated with the control cams 15, 16, since the control means 11 is displaced in the axial direction, so that the control means associated with the control cams 15, 16 comes into contact with the control cam 16 in a contact region 46 thereof. The control cams 13, 14, 15, 16 each always have a constant radius in the circumferential direction in their contact regions provided for control, so that micro-movements during a constant stroke adjustment, caused by an eccentricity, are avoided.

In addition to the adjustments described, further adjustments which appear useful to the person skilled in the art are possible. In particular, further control cams might be provided in the circumferential direction and/or in the axial direction, in which case the control means 11 might be displaced in the axial direction in order to obtain further modes. Furthermore, it is also possible to utilize superimposed rotational and thrust movements of the control means 11 and/or of the control means 12 for adjustments.

What is claimed is:

1. A stroke-transmitting device for a variable transmission of strokes to a means to be actuated, in particular for the variable transmission of a camshaft stroke to a gas-exchange valve (10) of an internal combustion engine, comprising a control unit having a first control means (11) and at least a second control means (12), at least one control cam (13, 14, 15, 16) coupling the first and second control means (11, 12) with contact regions (14, 34) and being displaceable relative to one another in a contact region of the control cam (13, 14, 15, 16) in at least one first degree of freedom (17) for a constant adjustment of the stroke, the first and second control means (11, 12) being axially displaceable relative to one another, and the first control means (11) being additionally also rotatable about its longitudinal axis (19) so as to provide for at least one second degree of freedom (18) differing from the first degree of freedom (17) in a contact region of the control cam (13, 14, 15, 16) in order to adjust the stroke.

2. The stroke-transmitting device as claimed in claim 1, wherein movements associated with the degrees of freedom (17, 18) are disposed at least substantially perpendicularly to one another.

3. The stroke-transmitting device as claimed in claim 1, wherein the control cam (13, 14, 15, 16) has a constant radius in at least one direction in at least one contour-following region.

4. The stroke-transmitting device as claimed in claim 1, wherein the control unit comprises at least one actuator (20) arranged at an end of one of the control means (11).

5. The stroke-transmitting device as claimed in claim 1, wherein at least the first control means (11) of the control unit has at least two control cams (13, 14, 15, 16) for at least two of said means to be actuated.

6. The stroke-transmitting device as claimed in claim 5, wherein the first and second control means (11, 12) are displaceable relative to one another in at least one degree of freedom in order to accommodate different modes of the means to be actuated.

7. The stroke-transmitting device as claimed in claim 6, wherein the degree of freedom for adjusting the difference deviates from the degree of freedom (18) with which a stroke-adjusting movement is associated.

8. The stroke-transmitting device as claimed in claim 7, wherein the degree of freedom for accommodating the different modes coincides at least substantially with the degree of freedom (17) with which a movement during a constant stroke-adjustment is associated.

9. The stroke-transmitting device as claimed in claim 1, comprising an intermediate lever (21) which is mounted in a spatially fixed manner.

10. The stroke-transmitting device as claimed in claim 9, wherein the intermediate lever (21) has at least one bearing zone (22, 23) for at least one of the control means (11, 12).

* * * * *